US007367136B1

(12) United States Patent
D'Antonio

(10) Patent No.: US 7,367,136 B1
(45) Date of Patent: May 6, 2008

(54) UMBRELLA AND SHOE DRYING DEVICE

(76) Inventor: Carlo J D'Antonio, 1651 Harbor Rd., Kissimmee, FL (US) 34746

( * ) Notice: Subject to any disclaimer, the term of this patent is extended or adjusted under 35 U.S.C. 154(b) by 328 days.

(21) Appl. No.: 11/181,047

(22) Filed: Jul. 14, 2005

(51) Int. Cl.
*F26B 25/00* (2006.01)

(52) U.S. Cl. ..... 34/107; 34/60; 34/90; 34/201; 34/202

(58) Field of Classification Search ..... 34/107, 34/201, 202, 233, 635, 587, 60, 61; 403/118, 403/120
See application file for complete search history.

(56) References Cited

U.S. PATENT DOCUMENTS

| | | | | |
|---|---|---|---|---|
| 1,712,022 A | | 3/1929 | Berg | |
| 2,199,194 A | | 4/1940 | Cohen | 312/149 |
| 2,373,339 A | | 4/1945 | Roberts | 34/53 |
| 4,570,358 A | | 2/1986 | Sacerdote | 34/54 |
| 5,261,541 A | | 11/1993 | Li | 211/62 |
| 5,595,434 A | * | 1/1997 | Pasch et al. | 362/102 |
| 5,625,960 A | | 5/1997 | Fujita | 34/80 |
| 5,938,049 A | | 8/1999 | Susholz | 211/62 |

FOREIGN PATENT DOCUMENTS

JP 01274800 A * 11/1989

* cited by examiner

*Primary Examiner*—Kenneth Rinehart
(74) *Attorney, Agent, or Firm*—Goldstein Law Offices P.C.

(57) ABSTRACT

An umbrella and shoe drying device, for use removing moisture, dirt, and debris from shoes and umbrellas, having a mat portion, a blower housing, and an umbrella holder. The mat portion has a substantially flat top surface having a grating upon which shoes are placed. The blower housing is mounted upon the flat top surface of the mat portion, supports the umbrella holder, and contains a blower. The umbrella housing has a main bore for accommodating umbrellas. The blower is in communication with the main bore and grating, and generates suction that removes moisture, dirt, and debris from umbrellas in the main bore and from shoes positioned upon the grating.

2 Claims, 7 Drawing Sheets

UMBRELLA AND SHOE DRYING DEVICE

BACKGROUND OF THE INVENTION

The invention relates to an umbrella and shoe drying device. More particularly, the invention relates to a device which provides an air current for cleaning and drying shoes and has a receptacle for holding and drying umbrellas.

When arriving at a business or residence during a rain or snow storm, a person often is wearing wet shoes and is carrying a wet umbrella. Wet shoes and a dripping umbrella are incompatible with most interior floor coverings and furnishings. At most residences, then, the practice is to leave the shoes and umbrellas at the door. For various reasons, however, this practice does not work well at a place of business.

Even in dry weather, however, shoes can pick up a wide variety of dirt, dust, debris, allergens, and germs while their wearer walks outdoors. When going back indoors, such items are easily re-deposited by the shoes on the floors of interior spaces, creating an unsightly appearance and even creating a health hazard.

U.S. Pat. Nos. 2,373,339 to Roberts; 4,570,358 to Sacerdote; 5,938,049 to Susholz; 5,261,541 to Li; and 5,625,960 to Fujita all disclose various devices for drying umbrellas. These devices, however, are not intended for drying shoes.

U.S. Pat. No. 1,712,022 to Berg discloses an umbrella holding device. U.S. Pat. No. 2,199,194 to Cohen discloses a combination umbrella stand and rubber utilities closet.

While these units may be suitable for the particular purpose employed, or for general use, they would not be as suitable for the purposes of the present invention as disclosed hereafter.

SUMMARY OF THE INVENTION

It is an object of the invention to produce a drying device capable of drying an umbrella and shoes. Accordingly the present invention provides an umbrella holder and a shoe mat, both the umbrella holder and mat connected to a blower assembly.

It is another object of the invention to provide a device that facilitates removal of dirt, debris, allergens, and germs from shoes. Accordingly, the blower draws air into the mat with powerful suction air current to remove particles from the shoes.

It is a further object of the invention to provide a drying device that is convenient to use, versatile, and is readily adaptable for use during wet and dry weather. Accordingly, the umbrella holder is selectively mounted onto the top surface of the main housing—adjacent to the mat. The umbrella holder is also selectively removable from the main housing to allow the device to function as a shoe cleaner during dry weather.

The invention is an umbrella and shoe drying device, for use removing moisture, dirt, and debris from shoes and umbrellas, having a mat portion, a blower housing, and an umbrella holder. The mat portion has a substantially flat top surface having a grating upon which shoes are placed. The blower housing is mounted upon the flat top surface of the mat portion, supports the umbrella holder, and contains a blower. The umbrella housing has a main bore for accommodating umbrellas. The blower is in communication with the main bore and grating, and generates suction that removes moisture, dirt, and debris from umbrellas in the main bore and from shoes positioned upon the grating.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
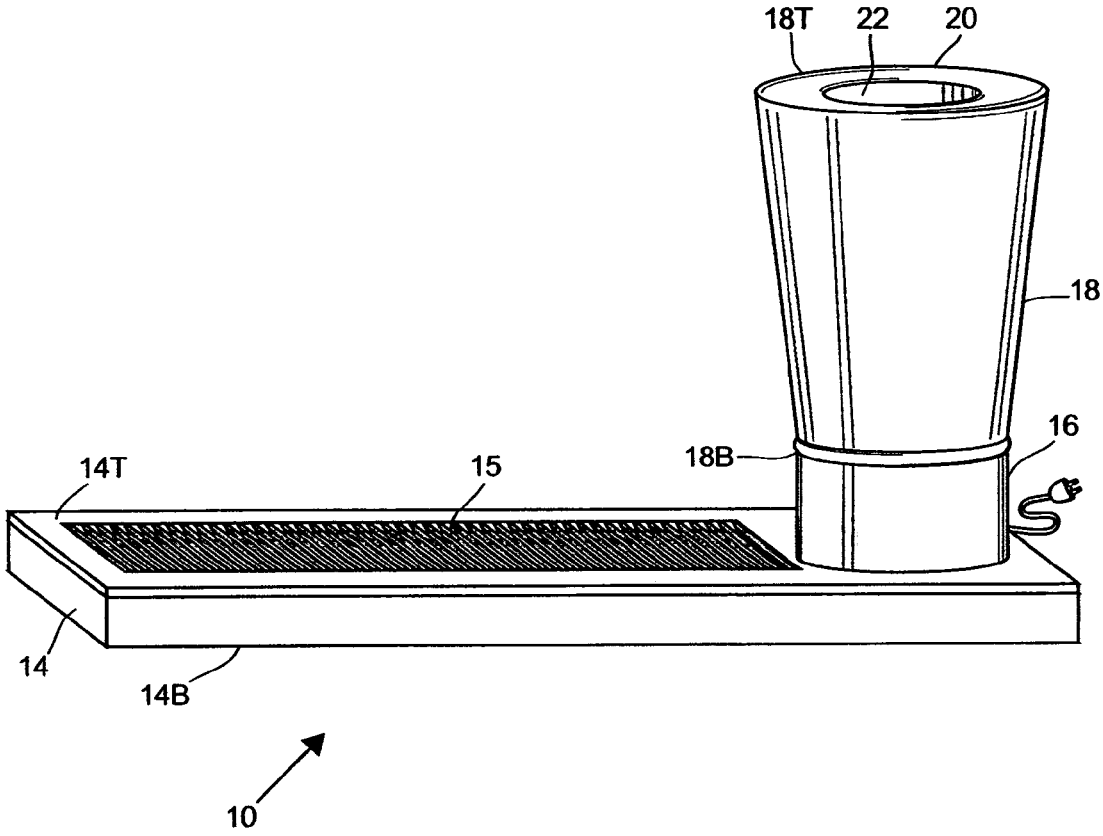
FIG. 1 is a diagrammatic perspective view, illustrating the present invention, per se.

FIG. 1 illustrates an umbrella and shoe drying device 10, having a mat portion 14, a blower housing 16, and an umbrella holder 18. The mat portion 14 has a substantially flat bottom surface 14B for resting upon an interior flooring surface, and a substantially flat top surface 14T. The blower housing 16 extends upwardly from the top surface 14T of the mat portion 14. The umbrella holder 18 extends upwardly from the blower housing 16, and thus is effectively positioned to extend upwardly from the mat portion 14.

Figure 3:
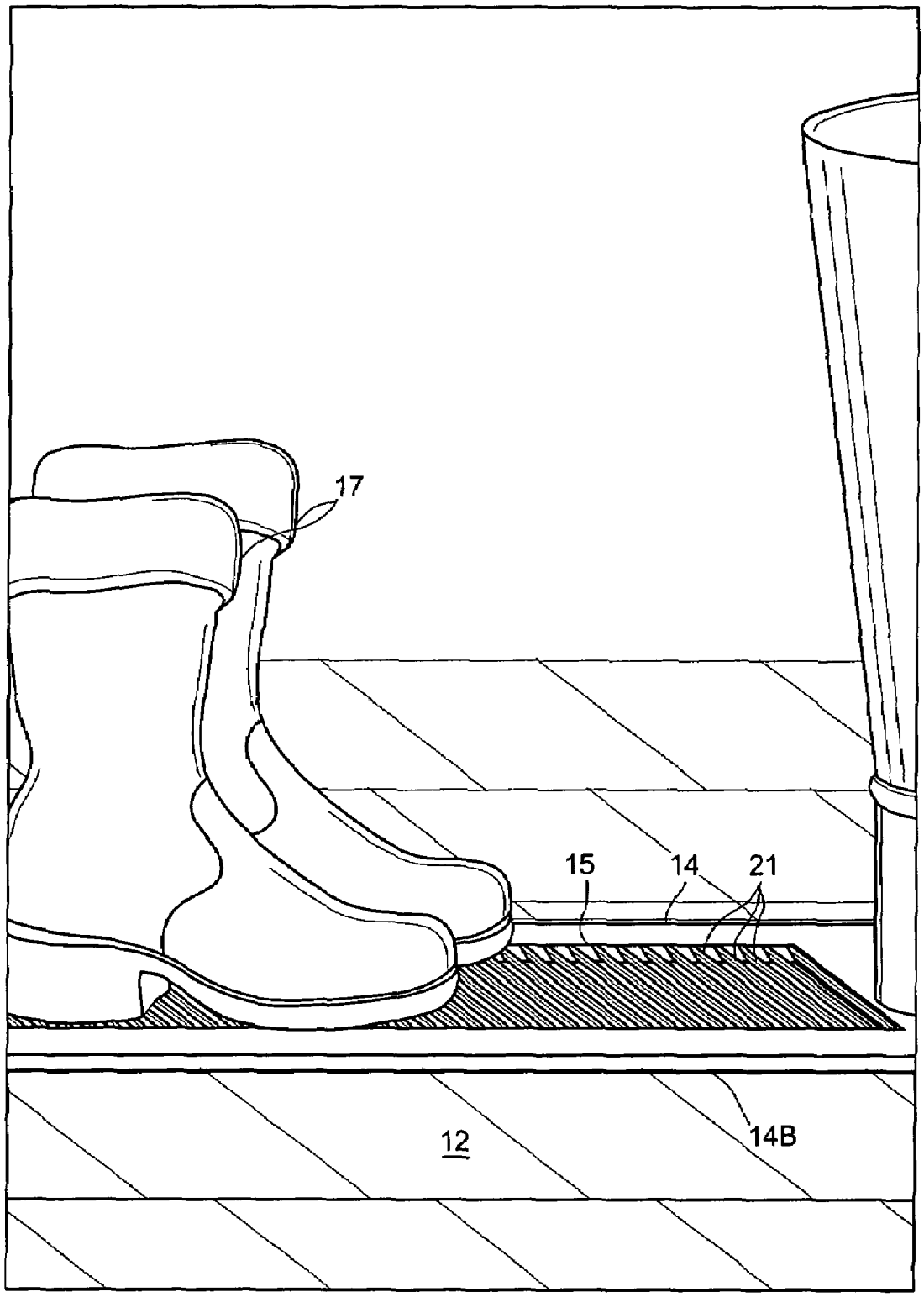
FIG. 3 is a diagrammatic perspective view, illustrating a pair of shoes positioned on the mat of the present invention for cleaning and drying.

The mat portion 14 includes a grating 15 that allows an air current to travel therethrough, but is fine enough to prevent shoe parts such as shoelaces from traveling therethrough. Referring to FIG. 3, a pair of shoes 17 has been placed on the mat portion 14, on top of the grating 15. The grating 15 has a plurality of evenly spaced vent tines 21. The vent tines 21 are spaced close enough together to accomplish the goals mentioned hereinabove. Also illustrated, the substantially flat bottom surface 14B of the mat portion 14 is positioned upon a flooring surface 12.

Figure 2:
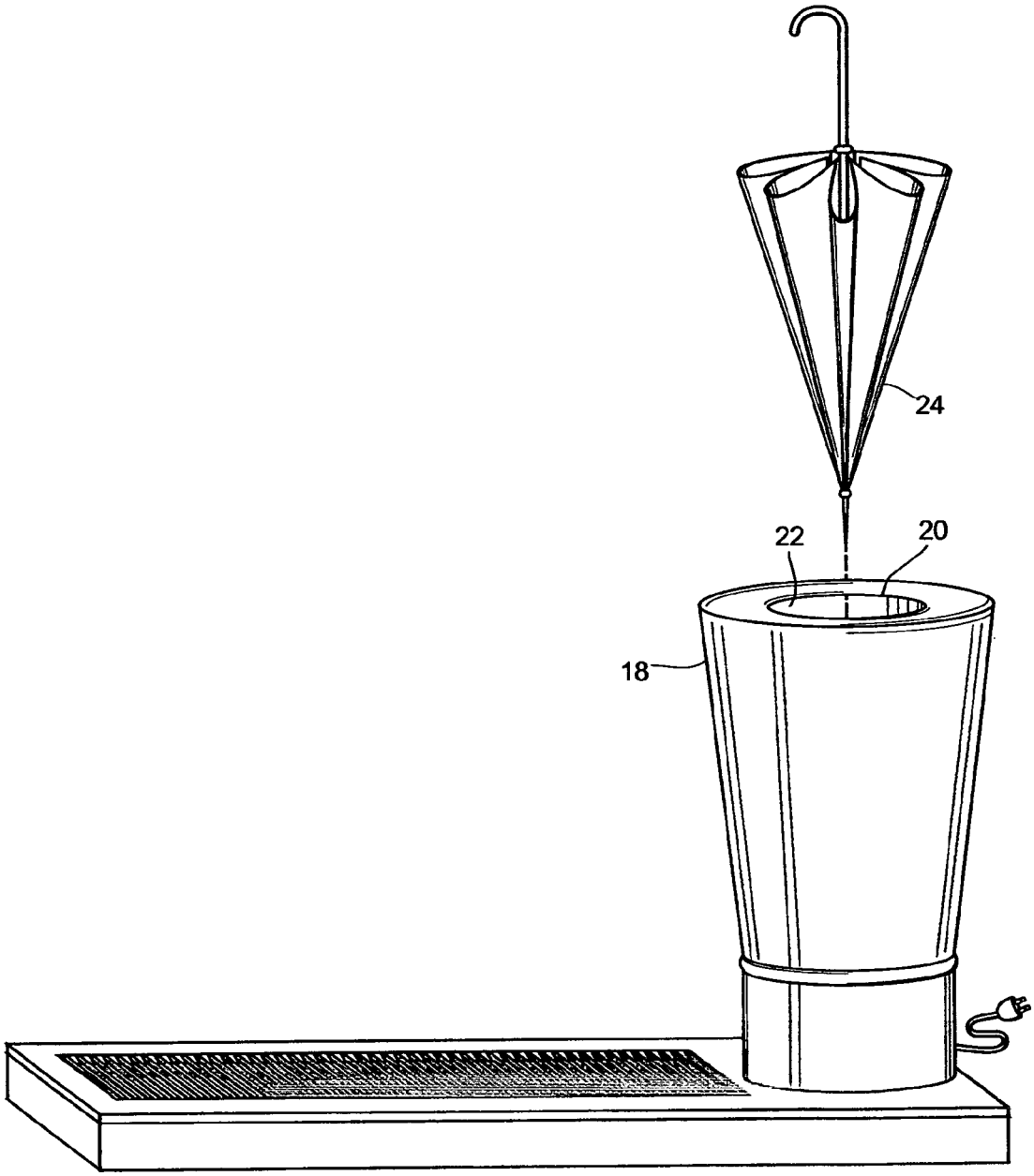
FIG. 2 is a diagrammatic perspective view, wherein an umbrella is being inserted into the umbrella holder of the present invention.

Referring again to FIG. 1, The umbrella holder 18 has a bottom 18B and a top 18T. The umbrella holder 18 is roughly cylindrical, but is flared outwardly between the bottom 18B and top 18T. The umbrella holder 18 has a top opening 20 and a main bore 22 extending downwardly from the top opening 20. Referring to FIG. 2, an umbrella 24 is being inserted downwardly into the main bore 22 of the umbrella holder 18 through the top opening 20.

Figure 6:
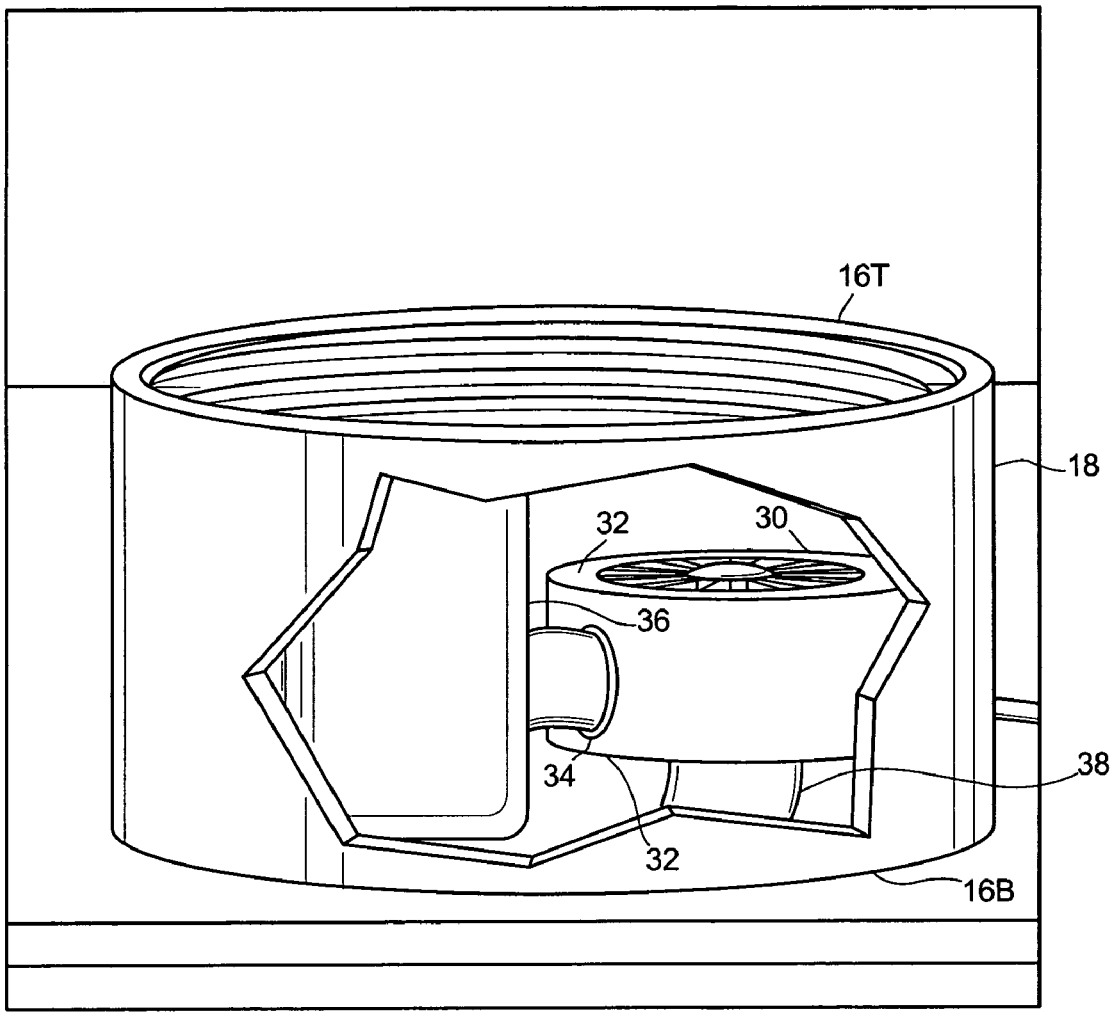
FIG. 6 is a diagrammatic perspective view with parts broken away, illustrating components within the blower housing.

As seen in FIG. 6, within the blower housing 16 is a blower 30 having outer surfaces 32 and a circumferential side surface 34. The blower 30 creates air flow and discharges air and debris contained therein into a collection container 36. The air flow created by the blower creates suction at both of the outer surfaces 32.

The blower housing 16 has a top 16T and a bottom 16B. The blower housing bottom 16B is attached on the top surface 14T of the mat portion 14. The blower housing 16 is open at the top 16T and is internally threaded downwardly from the top 16T. When the blower 30 is activated, suction is created at the open top 16T, creating air flow into the blower housing 16 at the top 16T. A grating suction tube 38 connects one of the outer surfaces 32 of the blower 30 with the grating 15. Accordingly, the blower 30 creates suction that helps remove moisture, dirt, debris, and the like from shoes. It should be appreciated by those skilled in the art that numerous configurations for the blower 16, collection container 36, and the like may be provided to effectuate removal of moisture, dirt, and debris from the grating 15 and main bore 22 of the umbrella holder 18.

Figure 4:
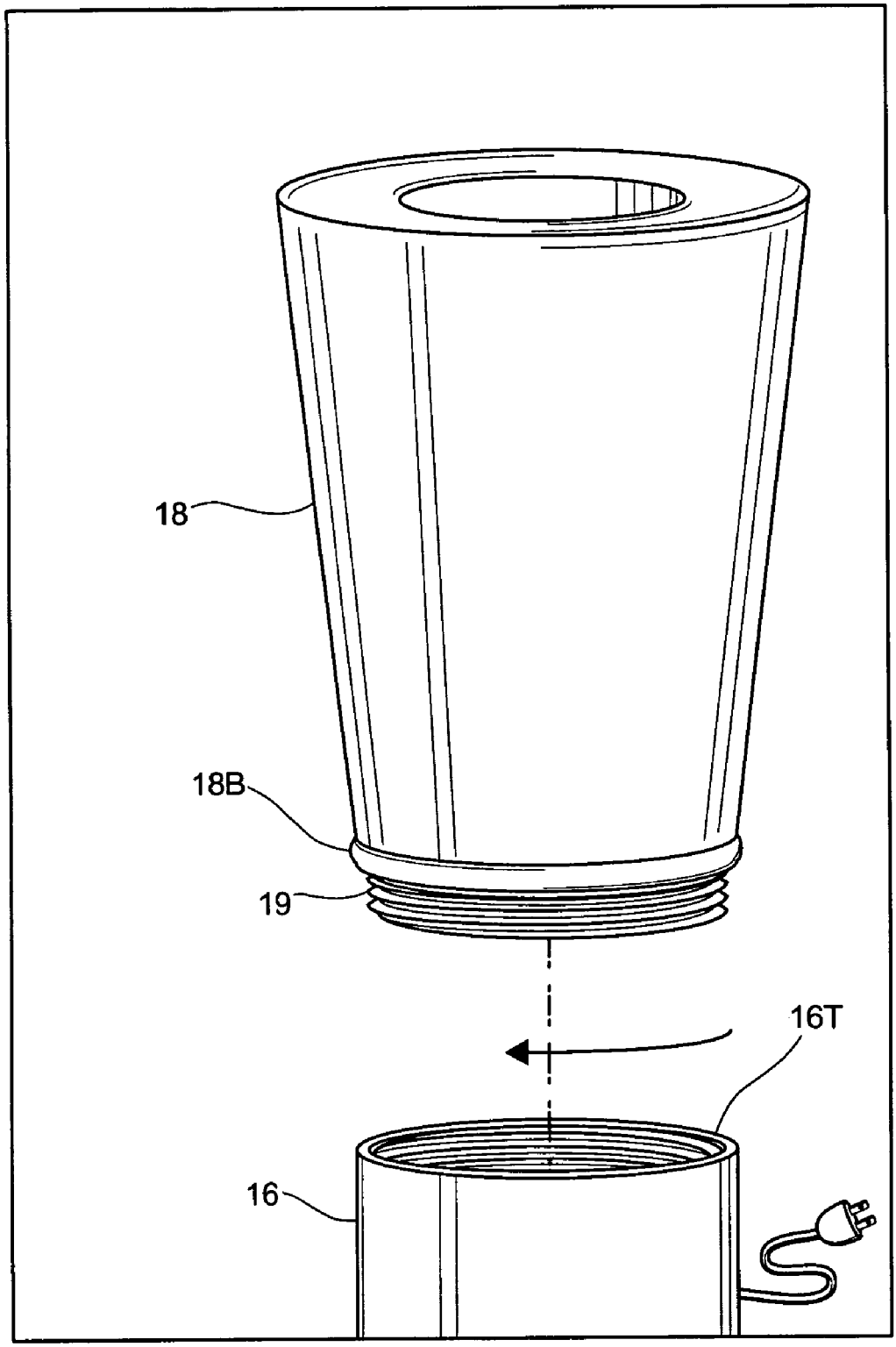
FIG. 4 is a diagrammatic perspective view, illustrating the umbrella holder being attached to the blower housing.

Referring to FIG. 4, the umbrella holder 18 is selectively attachable to the blower housing 16. Accordingly, the bottom 18B of the umbrella holder has an externally threaded neck 19 which selectively mates with the open top 16T of the blower housing 16. When the umbrella holder 18 is mated with the blower housing 16, a tight seal is created. Accordingly, a sealing ring is preferably provided on the neck 19 and/or within the open top 16T of the blower housing 16 to prevent air linkage therebetween.

Figure 7:
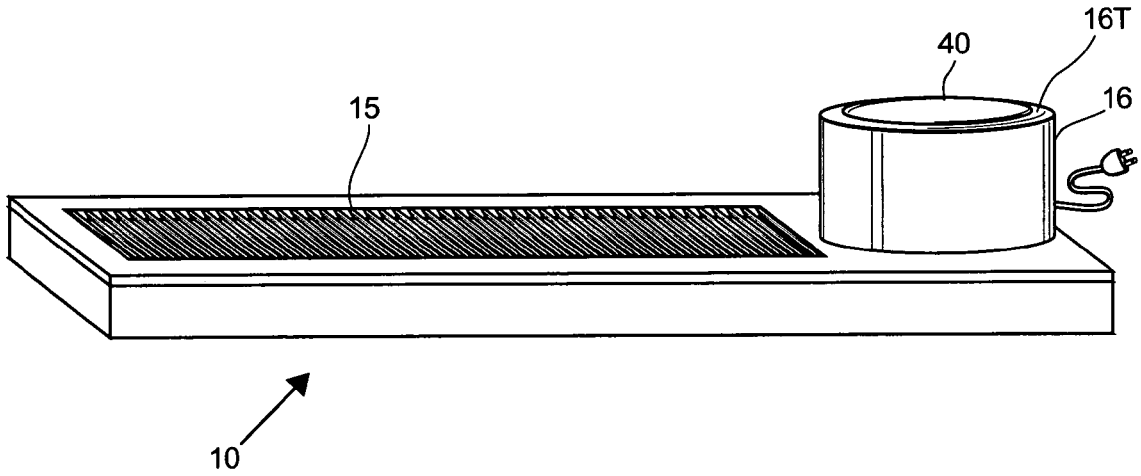
FIG. 7 is a diagrammatic perspective view, wherein the umbrella holder has been removed from the blower housing, which has been covered with a cap.

Referring to FIG. 7, in order to maintain suction through the grating 15 when the umbrella holder 18 is removed, a cap 40 is provided which selectively mates with and seals the open top 16T of the blower housing 16. Accordingly, suction created by the blower 30 through the grating 15 is effectively increased and the drying device 10 can function as an effective shoe dryer and debris remover.

Figure 5:
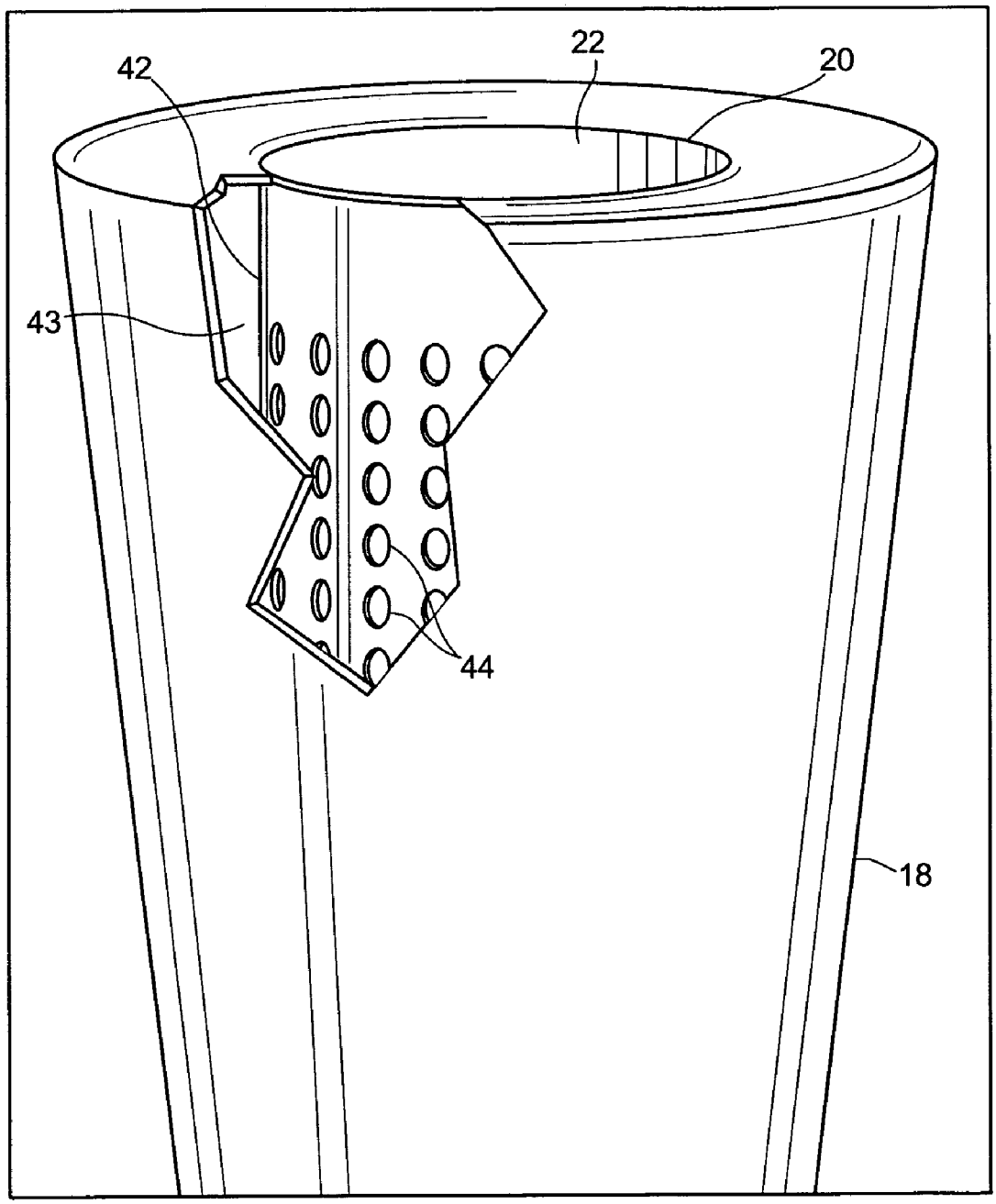
FIG. 5 is a diagrammatic perspective view with parts broken away, illustrating the perforated core of the umbrella holder.

FIG. 5 illustrates the umbrella holder 18, and internal details thereof. In particular, the main bore 22 of the umbrella holder is defined by a casing 42 that extends downwardly from the top opening 20 of the umbrella holder 18. The casing 42 is surrounded by an outer cavity 43 within the umbrella holder 18. Preferably the bottom 18B of the umbrella holder is open to the outer cavity 43 so that suction is generated within the outer cavity 43. The casing 42 has a plurality of perforations 44 that are extend through the casing 42 and provide gaseous and fluid communication between the main bore 22 and outer cavity 43. Accordingly, when suction is generated by the blower housing 16, moisture is drawn from the main bore 22 through the perforations 44 in the casing 42, into the outer cavity 43, and into the blower housing 16. The casing 42 and main bore 22 thereof is preferably sized to accommodate several umbrellas.

In conclusion, herein is presented an umbrella and shoe drying system. The invention is illustrated by example in the drawing figures, and throughout the written description. It should be understood that numerous variations are possible, while adhering to the inventive concept. Such variations are contemplated as being a part of the present invention.

What is claimed is:

1. An umbrella and shoe drying device, for removing moisture, dirt, and debris from umbrellas and shoes, comprising:

a mat portion having a substantially flat bottom, a substantially flat top surface, and a grating located on the top surface for allowing shoes to be placed thereon;

an umbrella holder, substantially cylindrical having a top and bottom, the bottom having an externally threaded neck, the umbrella holder extending upwardly from the mat portion, the umbrella holder having a main bore for accommodating umbrellas;

a blower housing having a bottom, and a top that is open and internally threaded, wherein the bottom of the umbrella holder selectively attaches to the blower housing by threading into the open top of the blower housing, the blower housing is positioned between the mat portion and umbrella holder such that the bottom is positioned upon the top surface of the mat surface;

a blower, located within the blower housing, in communication with the main bore of the umbrella holder and with the grating, for generating suction and an air current from the main bore and grating for removing moisture dirt and debris from shoes positioned upon the grating and umbrellas within the main bore; and a cap that is selectively attached to seal the open top of the blower housing when the umbrella housing is not attached to the blower housing to maintain suction to the grating.

2. The umbrella and shoe drying device as recited in claim 1, further comprising a collection container within the blower housing, in communication with the blower, for depositing moisture, dirt, and debris removed from the shoes and umbrellas.

* * * * *